US008434291B2

(12) United States Patent
Kraemer et al.

(10) Patent No.: US 8,434,291 B2
(45) Date of Patent: May 7, 2013

(54) SYSTEMS AND METHODS FOR DETECTING A FLAME IN A FUEL NOZZLE OF A GAS TURBINE

(75) Inventors: Gilbert Otto Kraemer, Greer, SC (US); James Michael Storey, Houston, TX (US); John Lipinski, Simpsonville, SC (US); Julio Enrique Mestroni, Marietta, GA (US); David Lee Williamson, Greer, SC (US); Jason Randolph Marshall, Moore, SC (US); Anthony Krull, Anderson, SC (US)

(73) Assignee: General Electric Company, Schenectady, NY (US)

( * ) Notice: Subject to any disclaimer, the term of this patent is extended or adjusted under 35 U.S.C. 154(b) by 770 days.

(21) Appl. No.: 12/350,626

(22) Filed: Jan. 8, 2009

(65) Prior Publication Data

US 2010/0170217 A1 Jul. 8, 2010

(51) Int. Cl.
*F23D 14/72* (2006.01)

(52) U.S. Cl.
USPC ..... 60/39.091; 60/779; 60/39.24; 60/39.11; 431/89; 431/90; 73/112.01; 702/138

(58) Field of Classification Search ..... 60/39.091, 60/779, 39.24, 772, 39.11; 374/144; 702/138; 73/112.01; 431/20, 89, 90
See application file for complete search history.

(56) References Cited

U.S. PATENT DOCUMENTS

| | | | | |
|---|---|---|---|---|
| 2,858,671 | A * | 11/1958 | Fox | 60/39.25 |
| 4,570,490 | A * | 2/1986 | Antonazzi | 73/701 |
| 4,744,670 | A * | 5/1988 | Janssen | 374/144 |
| 5,791,889 | A | 8/1998 | Gemmen et al. | |
| 5,857,320 | A | 1/1999 | Amos et al. | |
| 6,164,055 | A | 12/2000 | Lovett et al. | |
| 6,357,216 | B1 | 3/2002 | Scott et al. | |
| 6,438,961 | B2 | 8/2002 | Tuthill et al. | |
| 6,708,568 | B2 | 3/2004 | Gleeson et al. | |
| 6,848,319 | B2 | 2/2005 | Gleeson et al. | |
| 6,857,320 | B2 | 2/2005 | Gleeson et al. | |
| 6,978,680 | B2 | 12/2005 | Gleeson et al. | |
| 7,017,415 | B2 | 3/2006 | Harrold et al. | |
| 7,111,463 | B2 | 9/2006 | Sprouse et al. | |
| 7,721,553 | B2 | 5/2010 | Miller et al. | |
| 7,775,052 | B2 | 8/2010 | Cornwell et al. | |
| 7,788,895 | B2 | 9/2010 | Fujii | |
| 2006/0046218 | A1 | 3/2006 | Joklik et al. | |
| 2007/0006596 | A1 | 1/2007 | Fujii | |

OTHER PUBLICATIONS

Non-Final Office Action for U.S. Appl. No. 12/356,799 mailed Dec. 2, 2011.

Final Office Action for U.S. Appl. No. 12/356,799 mailed Apr. 6, 2012.

* cited by examiner

*Primary Examiner* — William H Rodriguez

*Assistant Examiner* — Steven Sutherland

(74) *Attorney, Agent, or Firm* — Sutherland Asbill & Brennan LLP

(57) ABSTRACT

A system may detect a flame about a fuel nozzle of a gas turbine. The gas turbine may have a compressor and a combustor. The system may include a first pressure sensor, a second pressure sensor, and a transducer. The first pressure sensor may detect a first pressure upstream of the fuel nozzle. The second pressure sensor may detect a second pressure downstream of the fuel nozzle. The transducer may be operable to detect a pressure difference between the first pressure sensor and the second pressure sensor.

21 Claims, 5 Drawing Sheets

SYSTEMS AND METHODS FOR DETECTING A FLAME IN A FUEL NOZZLE OF A GAS TURBINE

STATEMENT REGARDING FEDERALLY SPONSORED RESEARCH OR DEVELOPMENT

This invention was made with support of the United States government under Contract No. DE-FC26-05NT42643 awarded by the U.S. Department of Energy. The United States government may have certain rights in this invention.

TECHNICAL FIELD

The present disclosure generally relates to systems and methods for detecting a flame in a component of a gas turbine, and more particularly relates to systems and methods for detecting a flame in a fuel nozzle of a gas turbine.

BACKGROUND OF THE INVENTION

Many gas turbines include a compressor, a combustor, and a turbine. The compressor creates compressed air, which is supplied to the combustor. The combustor combusts the compressed air with fuel to generate an air-fuel mixture, which is supplied to the turbine. The turbine extracts energy from the air-fuel mixture to drive a load.

In many cases, the gas turbine includes a number of combustors. The combustors may be positioned between the compressor and the turbine. For example, the compressor and the turbine may be aligned along a common axis, and the combustors may be positioned between the compressor and the turbine at an entrance to the turbine, in a circular array about the common axis. In operation, air from the compressor may travel into the turbine through one of the combustors.

The combustors may be operated at a relatively high temperature to ensure the air and fuel are adequately combusted, improving efficiency. One problem with operating the combustors at a high temperature is that a relatively high level of nitrogen oxides (NOx) may be generated, which may have a negative impact on the environment.

To reduce NOx emissions, some modern gas turbines employ fuel nozzles. For example, each combustor may be supported by a number of fuel nozzles, such as premixed fuel nozzles, which may be positioned in a circular array about the combustor at an entrance to the combustor. During normal operation, the air from the compressor enters the combustor via the fuel nozzles. Within the fuel nozzles the air is "premixed" with fuel to form the air-fuel mixture. The air-fuel mixture is then combusted in the combustor. Pre-mixing the air and fuel permits operating the combustors at relatively lower temperatures, which reduces the NOx produced as a by-product of the combustion process.

Although pre-mixing in the fuel nozzles permits reduced NOx emissions, the fuel nozzles present their own problems. For example, the fuel nozzles may catch fire or retain flame. One common reason for flame in a fuel nozzle is flashback, wherein flame travels backward from the combustion zone of the combustor into the fuel nozzle. Another common reason for flame in the fuel nozzle is auto-ignition, wherein the fuel nozzle independently catches fire due to irregularities in the fuel composition, the fuel flow, the air flow, or the fuel nozzle surface, among others. Regardless of the cause, the fuel nozzle may tend to hold or retain the flame, which may damage the fuel nozzle or other portions of the gas turbine.

So that remedial action may be taken to reduce or eliminate flame in the fuel nozzle, techniques have been developed to detect the presence of flame in the fuel nozzles of the gas turbine. Many of these techniques employ sensors, such as temperature sensors, photon emission sensors, or ion sensors, among others. Typically, a sensor is positioned in each of the fuel nozzles so that flame in any one fuel nozzle may be detected. However, positioning a sensor in each fuel nozzle may be prohibitively expensive, as the turbine may be supported by a number of combustors, and each combustor may be supported by a number of fuel nozzles.

Accordingly, there is a need for systems and methods that detect the presence of a flame in a component of a gas turbine, such as a fuel nozzle of the gas turbine.

BRIEF DESCRIPTION OF THE INVENTION

A system may detect a flame about a fuel nozzle of a gas turbine. The gas turbine may have a compressor and a combustor. The system may include a first pressure sensor, a second pressure sensor, and a transducer. The first pressure sensor may detect a first pressure upstream of the fuel nozzle. The second pressure sensor may detect a second pressure downstream of the fuel nozzle. The transducer may be operable to detect a pressure difference between the first pressure sensor and the second pressure sensor.

Other systems, devices, methods, features, and advantages will be apparent or will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE DRAWINGS

The present disclosure may be better understood with reference to the following figures. Matching reference numerals designate corresponding parts throughout the figures, and components in the figures are not necessarily to scale.

DETAILED DESCRIPTION OF THE INVENTION

Described below are systems and methods for detecting a flame in a fuel nozzle of a gas turbine. The systems and methods may detect flame in a fuel nozzle by detecting an increase in a pressure drop across the fuel nozzle. For example, the systems and methods may detect flame in a fuel nozzle by detecting an increase in a pressure drop across an array of fuel nozzles associated with a certain combustor. The increased pressure drop may result due to the flame, which may increase the temperature and/or decrease the density of air flowing through the affected fuel nozzle. Due to the increased volume of the air, the pressure upstream of the fuel nozzles may increase, which may increase the pressure drop across the fuel nozzles.

In embodiments, the pressure drop may be determined across an array of fuel nozzles associated with a combustor. The pressure drop may be detected by determining a difference between an upstream pressure on an input side of the fuel nozzle array and an downstream pressure on an output side of the fuel nozzle array. If the pressure difference exceeds an expected pressure difference, a flame may be present in one or more fuel nozzles of the array. Thus, to detect a flame in any one of the fuel nozzles of the combustor, it may not be necessary to associate a sensor with each fuel nozzle, as the detection occurs at the combustor level instead of the nozzle level. Such a configuration may reduce the cost associated with flame detection.

In embodiments, the upstream pressure and the downstream pressure may be detected in close proximity to the nozzle array to increase the accuracy of the pressure readings. For example, the upstream pressure may be detected in an air flow path into the combustor, and the downstream pressure may be detected in a combustion chamber of the combustor. In such embodiments, an integrated probe may be employed to detect the pressure difference. The integrated probe may extend through a flow sleeve of the combustion into the combustion chamber. The integrated probe may be positioned to sense both the upstream pressure and downstream pressure simultaneously. In some such embodiments, the integrated probe may serve other functions. For example, the integrated probe may include a combustion dynamics monitoring (CDM) probe suited for monitoring dynamic pressure in the combustor. In such cases, it may be relatively easy and inexpensive to retrofit a gas turbine with the system for detecting flame in the fuel nozzles, such as by removing the CDM probe from the gas turbine and installing the integrated probe in its place.

Figure 1:
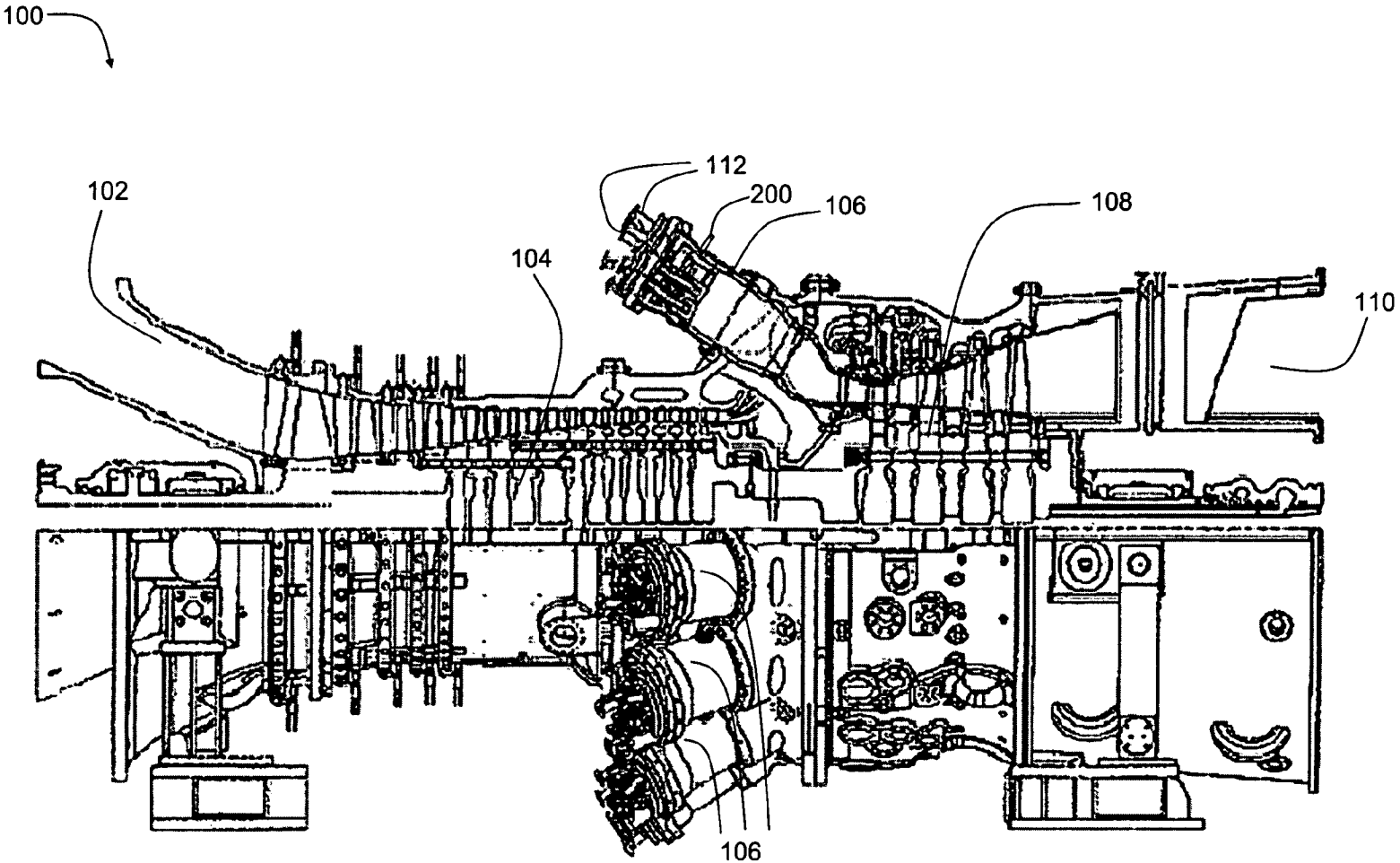
FIG. 1 is a partial cross-sectional view of a gas turbine, schematically illustrating a system for detecting a flame in a fuel nozzle of the gas turbine.

FIG. 1 is a partial cross-sectional view of a gas turbine 100 having a system for detecting a flame in a fuel nozzle. As shown, the gas turbine 100 generally includes an intake section 102, a compressor 104, one or more combustors 106, a turbine 108, and an exhaust section 110. Each combustor 106 may include one or more fuel nozzles 112. The fuel nozzles 112 may be in parallel to each other in an array. For example, the fuel nozzles 112 may be arranged about an entrance to the combustor 106, such as in a circular configuration about a longitudinal axis of the combustor 106.

A flow path may be defined through the gas turbine 100. During normal operation, air may enter the gas turbine 100 through the intake section 102. The air may flow into the compressor 104, which may compress the air to form compressed air. The compressed air may flow through the fuel nozzles 112, which may mix the compressed air with fuel to form an air-fuel mixture. The air-fuel mixture may flow into the combustor 106, which may burn the air-fuel mixture to generate hot gases. The hot gases may flow into the turbine 108, which may extract energy from the hot gases, forming exhaust. Thereafter, the exhaust may be exhausted from the gas turbine 100 through the exhaust section 110.

Hereinafter, the combustor 106 is described as having an array of fuel nozzles 112, although a person of skill would appreciate that only one fuel nozzle 112 may be provided. Focusing on the portion of the flow path in the vicinity of the array of fuel nozzles 112, a pressure drop may be expected across the nozzle array. During normal operation, a pressure upstream of the array of fuel nozzles 112 may exceed a pressure downstream of the array of fuel nozzles 112. For the purposes of this disclosure, the term "upstream pressure" is defined to be a static pressure of compressed air at a point between the compressor exit and an entrance to any one of the fuel nozzles 112. The upstream pressure is also referred to herein as the compressor discharge pressure (PCD). A person of skill would appreciate that the upstream pressure may vary along the flow path between the compressor exit and the fuel nozzle entrance, and that each of these pressures constitutes a compressor discharge pressure (PCD). A person of skill would also appreciate that the compressor discharge pressure (PCD) may not be assessed at the compressor discharge exactly. For the purposes of this disclosure, the term "downstream pressure" is defined to be the static pressure within the combustor 106. The downstream pressure is also referred to herein as a combustor chamber pressure (PCC), as the downstream pressure may be taken from within the combustor chamber.

As mentioned, the upstream pressure may exceed the downstream pressure under normal operating conditions. Such an expected pressure difference between the upstream and downstream pressures (PCD-PCC) may assist with driving flow along the flow path. The expected pressure difference may be within a known range, which may vary depending on, for example, the configuration of the gas turbine 100 or the current operating conditions.

In some situations, a flame may be present in one or more fuel nozzles 112 of the gas turbine 100. The flame may be due to, for example, flashback or auto-ignition. Flashback denotes the propagation of flame from the combustion reaction zone of the combustor 106 into a fuel nozzle 112, while auto-ignition denotes spontaneous ignition of the air-fuel mixture within a fuel nozzle 112. However, a flame may be present in a fuel nozzle 112 for any other reason.

Thus, the gas turbine 100 may include a system 200 for detecting a flame in a fuel nozzle 112 of the gas turbine 100. The system 200 may detect a flame in any one of the fuel nozzles 112 by detecting an increase in the pressure difference across the array of fuel nozzles 112.

When a flame is present in an affected fuel nozzle 112, the compressed air traveling through the affected fuel nozzle 112 may become hotter and may expand, which may increase the air flow resistance through the affected fuel nozzle 112. Thus, the air may be relatively less able to flow through the affected fuel nozzle 112. To compensate for the decreased air flow through the affected fuel nozzle 112, the compressed air may be re-directed through the remaining fuel nozzles 112. Thus, a relatively larger volume of air may be forced to travel through relatively less fuel nozzle space, which may increase the pressure upstream of the fuel nozzles 112.

Due to the increased upstream pressure and the decreased downstream pressure, when any one of the fuel nozzles 112 holds flame, a pressure difference across the array of fuel nozzles 112 may increase. More specifically, a pressure drop across the array of fuel nozzles 112 may exceed an expected pressure drop. Stated alternatively, the difference between the compressor discharge pressure (PCD) and the combustor chamber pressure (PCC) may be relatively larger when a flame is present in any one of the fuel nozzles 112 than during normal operation of the gas turbine 100. For example, the pressure difference may be about 5-10% higher than a predetermined pressure. Such a change in pressure difference may be detected by the system 200 to determine that one or more of the fuel nozzles 112 is holding flame. With this knowledge, remedial action may be taken to protect the gas turbine 100 from further damage. For example, the flame may be reduced or extinguished in any manner now known or later developed.

Figure 2:
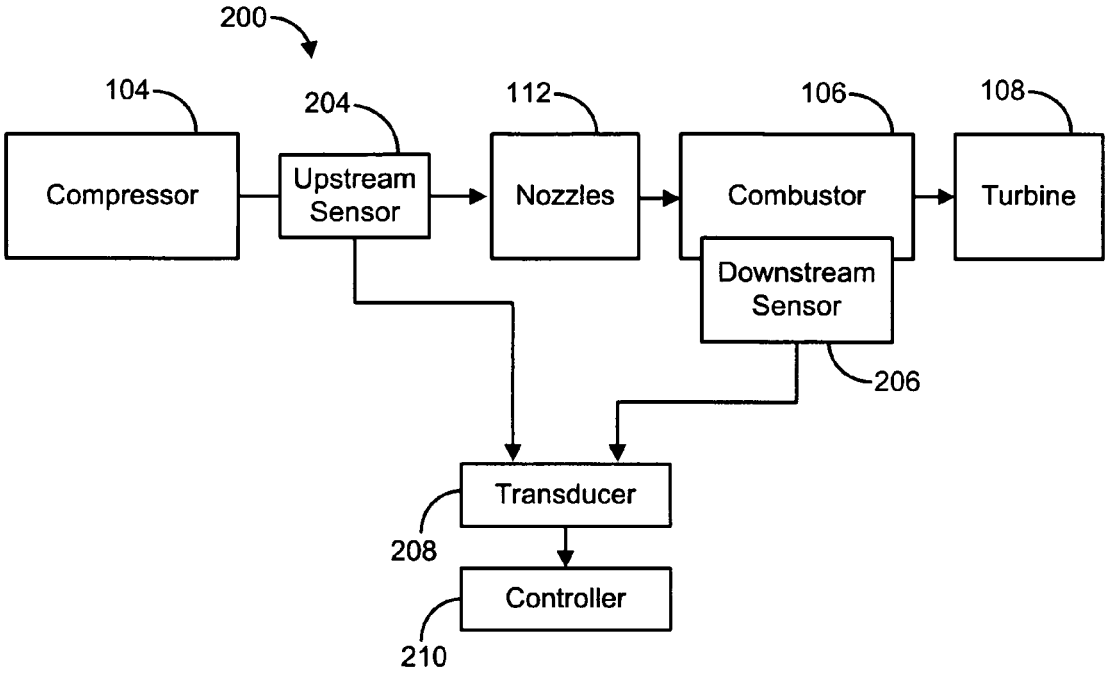
FIG. 2 is a block diagram illustrating an embodiment of a system for detecting a flame in a fuel nozzle of a gas turbine.

FIG. 2 is a block diagram illustrating an embodiment of the system 200 for detecting a flame in the fuel nozzle 112 of the gas turbine 100. As shown, the system 200 may include an upstream pressure sensor 204, a downstream pressure sensor 206, and a transducer 208. The upstream pressure sensor 204 may be positioned between the compressor 104 and the fuel nozzles 112. The upstream pressure sensor 204 may detect the compressor discharge pressure (PCD). The downstream pressure sensor 206 may be at least partially positioned within the combustor 106. The downstream pressure sensor 206 may detect the combustor chamber pressure (PCC). The pressure sensors 204, 206 may be operatively associated with a transducer 208, such as a differential pressure transducer. The transducer 208 may detect a pressure difference between the upstream pressure and the downstream pressure. The pressure sensors 204, 206 may be connected to the transducer 208 in any possible manner. For examples, the pressure sensors 204, 206 may be separate physical components operatively connected to the transducer 208, or the pressure sensors 204, 206 may be figurative functions of the transducer 208. In other words, the transducer 208 may detect a pressure difference between the upstream and downstream pressures, instead of taking an independent measurement of the upstream pressure, taking an independent measurement of the downstream pressure, and subtracting the two measurements to determine the pressure difference.

In some embodiments, the pressure sensors 204, 206 may be operatively associated with a number of pressure transducers 208, which may enable redundant detection and may reduce the likelihood of false indications of flame. Also in some embodiments, a number of pressure sensors 204, 206 may be operatively associated with the one or a number of pressure transducers 208, for the same reasons. In such cases, a typical voting procedure may be employed to determine if a false indication of flame has occurred.

In embodiments, the system 200 may further include a controller 210. The controller 210 may be implemented using hardware, software, or a combination thereof for performing the functions described herein. By way of example, the controller 210 may be a processor, an ASIC, a comparator, a differential module, or other hardware means. Likewise, the controller 210 may comprise software or other computer-executable instructions that may be stored in a memory and executable by a processor or other processing means.

The controller 210 may receive the detected pressure difference from the transducer 208, such as by way of a signal. The controller 210 may also be aware of an expected pressure difference. For example, the controller 210 may store the expected pressure difference, such as in a memory of the controller 210. The controller 210 may also determine the expected pressure difference, such as by applying an algorithm to known parameters of the gas turbine 100 or measured operating conditions of the gas turbine 100, among others. The controller 210 may compare the detected pressure difference to the expected pressure difference, and in the event that the detected pressure difference exceeds the expected pressure difference, the controller 210 may indicate that the flame condition exists in the gas turbine 100. In some embodiments, the expected pressure difference may include a range of acceptable pressure differences, in which case the controller 210 may compare the detected pressure difference to the range of expected pressure difference to determine whether the detected pressure difference falls within the range. If the detected pressure difference is not within the range, the controller 210 may indicate the presence of the flame in the fuel nozzle 112.

Figure 3:
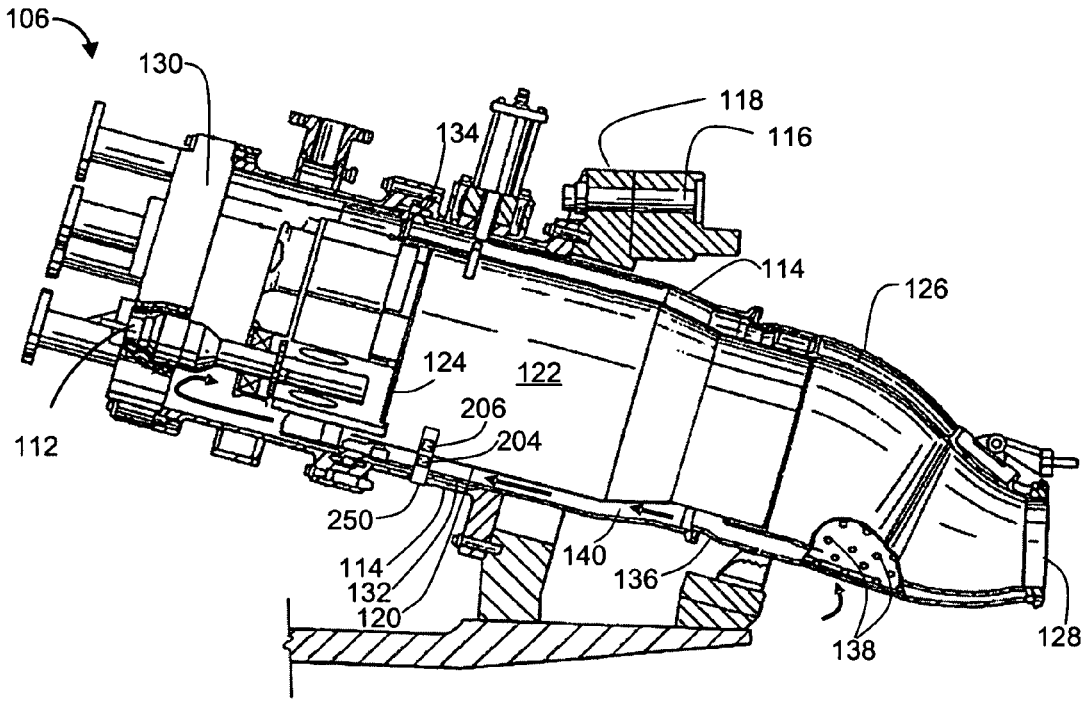
FIG. 3 is a partial cross-sectional view of a combustor of a gas turbine, illustrating an embodiment of probe for detecting a flame in a fuel nozzle of a gas turbine.
Figure 4:
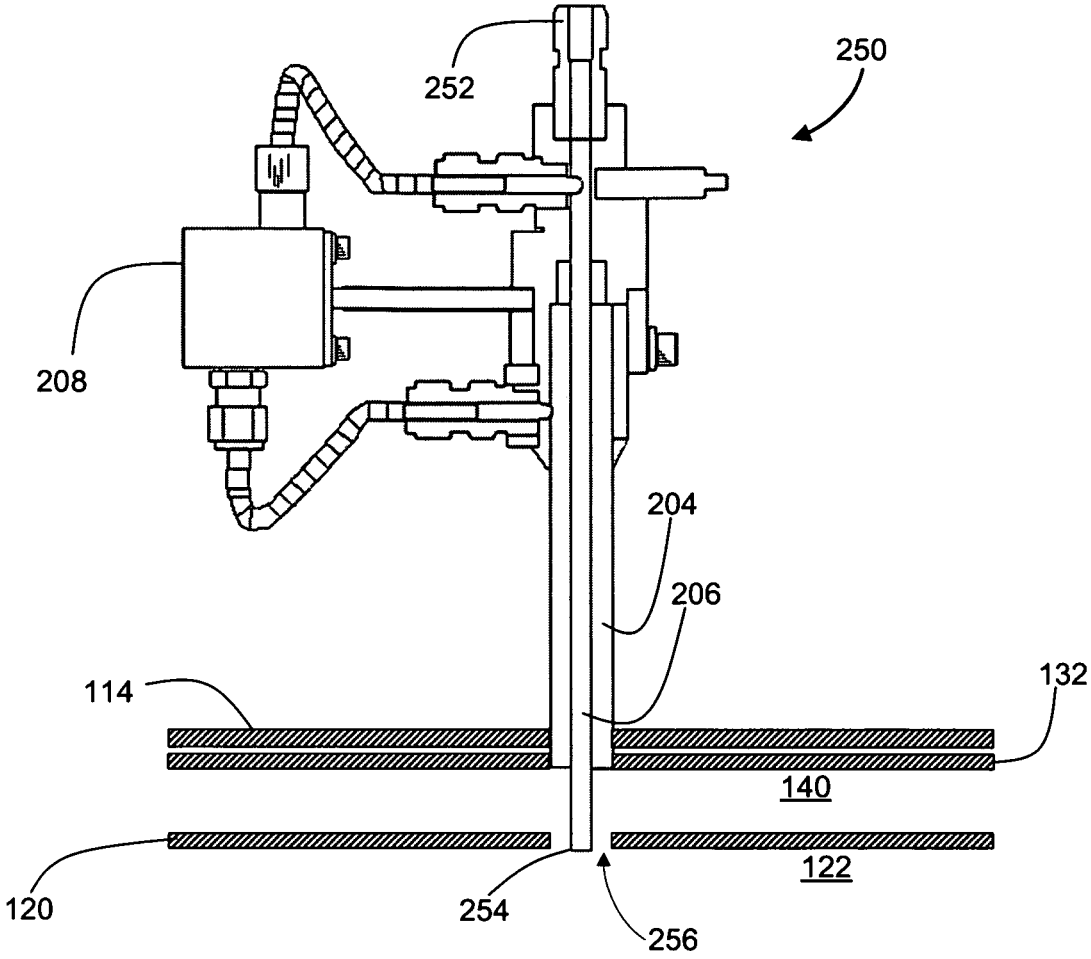
FIG. 4 is partial cross-sectional view of the probe shown in FIG. 3.

In embodiments, the upstream and downstream pressure sensors 204, 206 may be positioned in close proximity to the fuel nozzles 112. Such a configuration is illustrated in FIGS. 3 and 4, which are partial cross-sectional views of a combustor 106 of the gas turbine 100 and an integrated probe 250, respectively. As shown, an exterior of the combustor 106 may be defined by a combustor casing 114. The combustor casing 114 may be suited for securing the combustor 106 to the turbine 108, such as by way of bolts 116 extending between the combustor casing 114 and a turbine casing 118 (partially shown). The combustor casing 114 may be substantially cylindrical in shape. A combustion liner 120 may be positioned on an interior of the combustion casing 114. The combustion liner 120 may also be substantially cylindrical in shape and may be concentrically disposed with reference to the combustor casing 114. The combustion liner 120 may define the periphery of a combustor chamber 122, which may be suited for burning the air-fuel mixture as mentioned above. The combustion chamber 122 may be bounded on an inlet end by a liner cap assembly 124 and on an outlet end by a transition duct 126. The transition duct 126 may connect an outlet 128 of the combustor 106 with an inlet to the turbine 108, so that hot gas produced upon combustion of the air-fuel mixture can be directed into the turbine 108.

To provide the air-fuel mixture to the combustion chamber 122, a number of fuel nozzles 112 may be in fluid communication with the interior of the combustion chamber 122. The fuel nozzles 112 may be positioned in parallel to each other at the input end of the combustor 106. More specifically, the fuel nozzles 112 may extend through a cap assembly 130 that encloses the combustor casing 114 at the input end, and through the liner cap assembly 124 that encloses the combustion chamber 122 at the input end. The fuel nozzles 112 may receive air from the compressor 104, may mix the air with fuel to form the air-fuel mixture, and may direct the air-fuel mixture into the combustion chamber 122 for combustion. In the illustrated embodiment, only one fuel nozzle 112 is shown in detail for the sake of clarity.

So that air from the compressor 104 can reach the fuel nozzles 112, a flow sleeve 132 may be positioned about the combustor 106. As shown, the flow sleeve 132 may be substantially cylindrical in shape and may be concentrically positioned between the combustor casing 114 and the combustor liner 120. More specifically, the flow sleeve 132 may extend between a radial flange 134 of the combustor casing 114 and an outer wall 136 of the transition duct 126. An array of apertures 138 may be formed through the flow sleeve 132 near the transition duct 126. The apertures 138 may permit air from the compressor 104 to flow, in a reverse direction, from the compressor 104 toward the fuel nozzles 112. More specifically, the air may flow along an air flow path 140 defined in an annular space between the flow sleeve 132 and the combustor liner 120, as indicated by the arrows.

As mentioned above, the upstream and downstream pressure sensors 204, 206 may be positioned in close proximity to the fuel nozzles 112, which may reduce the likelihood of inaccuracies in the pressure readings. For example, the upstream pressure sensor 204 may be positioned in the air flow path 140 between the flow sleeve 132 and the combustion liner 120, which permits detecting the compressor discharge pressure (PCD) in close proximity to the array of fuel nozzles 112. Similarly, the downstream pressure sensor 206 may be positioned near the combustion liner 120 or in the combustion chamber 122, which permits detecting the combustor chamber pressure (PCC) in close proximity to the array of fuel nozzles 112. By positioning the sensors 204, 206 in close proximity to the array of fuel nozzles 112, the sensors 204, 206 may be relatively less likely to detect pressure aberrations attributable to causes other than flame in a fuel nozzle 112.

In embodiments, the upstream and downstream pressure sensors 204, 206 may be components of an integrated probe 250. The integrated probe 250 may be operable to detect an increase in a pressure difference across the fuel nozzles 112, such as a difference between the compressor discharge pressure (PCD) and the combustor chamber pressure (PCC). For example, the integrated probe 250 may be a differential pressure probe.

The probe 250 may be associated with the combustor 106 as shown in FIGS. 3 and 4. Specifically, the probe 250 may extend through the combustion casing 114, the flow sleeve 132, and the combustion liner 120, and into the combustion chamber 122. The upstream pressure sensor 204 may be positioned on a portion of the probe 250 that becomes positioned in the air flow path 140 into the combustor 106, such as between the flow sleeve 132 and the combustion liner 120. The downstream pressure sensor 206 may be positioned on a portion of the probe 250 that becomes positioned in the combustion chamber 122. Thus, both the compressor discharge pressure (PCD) and the combustor chamber pressure (PCC) may be sensed using a single probe 250. As shown in FIG. 4, the integrated probe 250 may also include the transducer 208. Although the controller 210 is not shown in the illustrated embodiment, the probe 250 may also include the controller 210. Alternatively, the controller 210 may be separate from the probe 250.

In embodiments, the positioning of the downstream pressure sensor 206 within the combustion chamber 122 may be selected to reduce the effect of the temperature within the combustion chamber 122 on the downstream pressure sensor 206. For example, the temperature within the combustion chamber 122 may exceed the temperature that can be tolerated by the downstream pressure sensor 206. Therefore, the downstream pressure sensor 206 may be positioned within the combustion chamber such that a tip 254 of the downstream pressure sensor 206 is near the combustion liner 120. For example, the tip 254 may be about flush with the combustion liner 120 as shown. In some cases, a slight air gap 256 may be formed about the tip 254. The air gap 256 may permit a cooling air flow, which may further reduce the impact of temperature on the downstream pressure sensor 206.

The integrated probe 250 may reduce the cost of retrofitting the gas turbine with the system 200 for detecting flame in the fuel nozzle of the gas turbine, as the integrated probe 250 can detect flame in any one of the fuel nozzles 112 by detecting the pressure drop across the array of fuel nozzles 112. Individual sensors may not be needed within each fuel nozzle 112, reducing implementation and maintenance costs.

In embodiments, the integrated probe 250 may be associated with an existing probe of the gas turbine, such as a combustor dynamics monitoring (CDM) probe. The combustion dynamics monitoring (CDM) probe may be used for measuring parameters of the gas turbine, such as a dynamic pressure of the combustion chamber 122. In such embodiments, the downstream pressure sensor 206 may have a concentric axial bore, which permits transmitting a dynamic pressure signal from the combustion chamber 122 to a pressure dynamic pressure sensor 252 located on the integrated probe 250. In such embodiments, retrofitting a gas turbine with the integrated probe 250 may be as simple as replacing the existing combustion dynamic monitoring (CDM) probe with the integrated probe 250 shown in FIG. 4.

Figure 5:
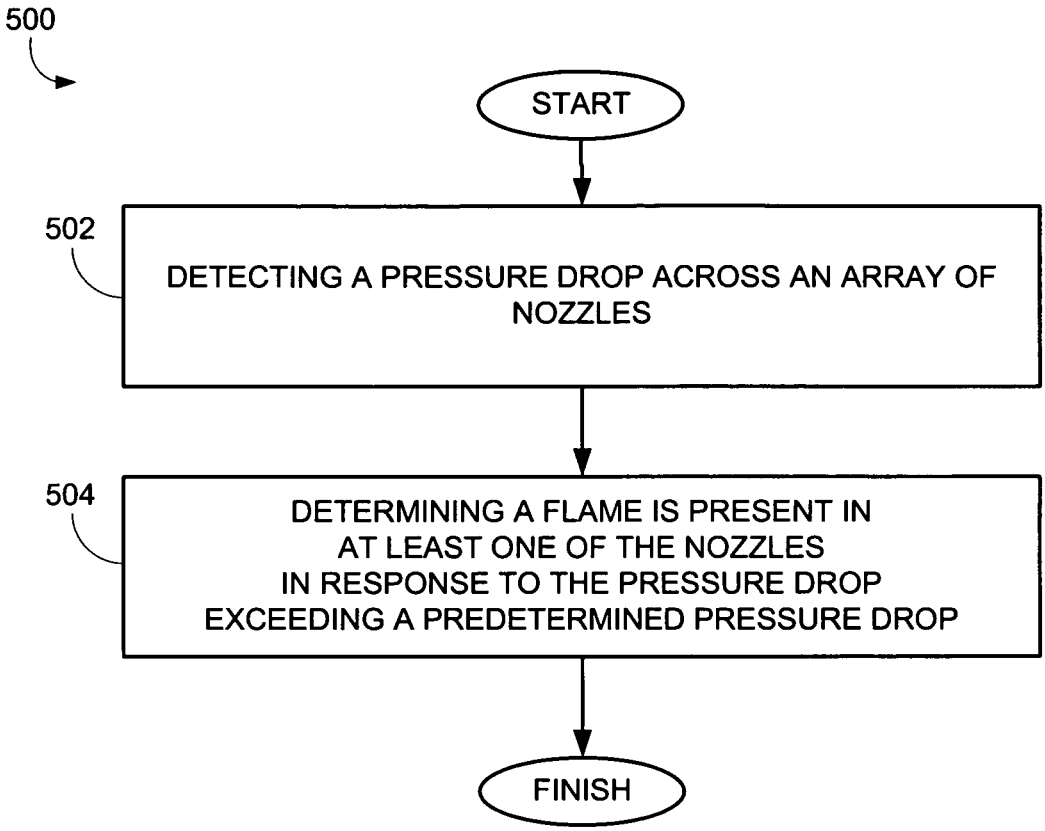
FIG. 5 is a block diagram illustrating an embodiment of a method for detecting a flame in a fuel nozzle of a gas turbine.

FIG. 5 is a block diagram illustrating an embodiment of a method 500 for detecting a flame in a fuel nozzle of a gas turbine. In block 502, a pressure drop may be detected across an array of fuel nozzles. For example, the pressure drop may be detected by detecting a pressure difference between the compressor discharge pressure (PCD) and the combustor chamber pressure (PCC), such as by using one of the systems described above. In block 504, a flame may be determined to present in at least one of the fuel nozzles in response to the pressure drop exceeding an expected pressure drop. For example, the flame may be determined to be present by comparing the detected pressure drop to an expected pressure drop. In some embodiments, the expected pressure drop may be a range of expected pressure drops, in which case the flame may be determined to be present by determining that the detected pressure drop does not fall within the range of expected pressure drops. Thereafter, the method 500 ends. In embodiments, the method 500 may further include extinguishing the flame. The flame may be extinguished in any manner.

Embodiments of the invention are described above with reference to block diagrams and schematic illustrations of methods and systems according to embodiments of the invention. It will be understood that each block of the diagrams and combinations of blocks in the diagrams can be implemented by computer program instructions. These computer program instructions may be loaded onto one or more general purpose computers, special purpose computers, or other programmable data processing apparatus to produce machines, such that the instructions that execute on the computers or other programmable data processing apparatus create means for implementing the functions specified in the block or blocks. Such computer program instructions may also be stored in a computer-readable memory that can direct a computer or other programmable data processing apparatus to function in a particular manner, such that the instructions stored in the computer-readable memory produce an article of manufacture including instruction means that implement the function specified in the block or blocks.

Although the systems and methods for detecting flame in a fuel nozzle of a gas turbine are described above with reference to gas turbines having an array of fuel nozzles, a person of skill would appreciate that the systems and methods may be employed with a combustor having only one fuel nozzle.

At least the following is claimed:

1. A method of detecting a flame within a premixing fuel nozzle of a gas turbine, the gas turbine comprising one or more premixing fuel nozzles positioned between a compressor and a combustor, the method comprising:

detecting a pressure drop across the one or more premixing fuel nozzles based at least in part on a change in volumetric flow rate within the one or more premixing fuel nozzles; and determining that the flame is present within at least one premixing fuel nozzle in response to the pressure drop exceeding a predetermined pressure drop.

2. The method of claim 1, wherein detecting a pressure drop across the one or more premixing fuel nozzles comprises detecting a difference between a compressor discharge pressure and a combustion chamber pressure.

3. The method of claim 2, wherein detecting a pressure drop across the one or more premixing fuel nozzles further comprises comparing the pressure drop to a predetermined pressure drop.

4. The method of claim 1, further comprising extinguishing the flame in the premixing fuel nozzle.

5. The method of claim 1, wherein the change in volumetric flow rate within the one or more premixing fuel nozzles is based at least in part on a decrease in air flow density flowing through the one or more premixing nozzle where the flame is present.

6. A system for detecting a flame within a premixing fuel nozzle of a gas turbine having a compressor and a premixed combustor, the system comprising:

a first pressure sensor that detects a first pressure upstream of the premixing fuel nozzle;

a second pressure sensor that detects a second pressure downstream of the premixing fuel nozzle; and a transducer operable to detect a pressure difference between the first pressure and the second pressure based at least in part on a change in volumetric flow rate within the premixing fuel nozzle for detecting a flame within the premixing fuel nozzle.

7. The system of claim 6, wherein the first pressure sensor is positioned in an air flow path into the premixed combustor.

8. The system of claim 7, wherein the air flow path comprises an area between a casing of the premixed combustor and a chamber of the premixed combustor.

9. The system of claim 6, wherein the second pressure sensor is positioned in a chamber of the premixed combustor.

10. The system of claim 6, wherein the transducer comprises a differential pressure transducer.

11. The system of claim 6, further comprising an integrated probe, the integrated probe extending through an air flow path into the premixed combustor into a premixed combustion chamber.

12. The system of claim 11, wherein:

the first pressure sensor is located on a portion of the integrated probe that is positioned in an air flow path; and the second pressure sensor is located on a portion of the integrated probe that is positioned in the premixed combustion chamber.

13. The system of claim 11, wherein the integrated probe further comprises a premixed combustion dynamics monitoring probe.

14. The system of claim 11, wherein the integrated probe is further operable to perform premixed combustor dynamics monitoring.

15. The system of claim 6, further comprising a controller operable to indicate that the flame exists in the premixing fuel nozzle of the gas turbine in response the pressure difference exceeding a predetermined pressure difference.

16. A system for detecting a flame condition in a gas turbine, the gas turbine comprising a compressor, a premixed combustor, and a plurality of premixing fuel nozzles, the system comprising:

a differential pressure probe operable to detect an increase in a pressure difference across the plurality of premixing fuel nozzles based at least in part on a change in volumetric flow rate within the plurality of premixing fuel nozzles; and a controller operable to respond to the increase in the pressure difference by indicating that the flame condition exists in at least one of the plurality of premixing fuel nozzles.

17. The system of claim 16, wherein:

the plurality of premixing fuel nozzles are positioned in parallel between the compressor and the premixed combustor; and the controller is operable to respond to the increase in the pressure difference by indicating that the flame condition exists in at least one of the plurality of premixing fuel nozzles.

18. The system of claim 16, wherein the differential pressure probe comprises:

a first pressure sensor operable to detect a compressor discharge pressure; and a second pressure sensor operable to detect a premixed combustor chamber pressure.

19. The system of claim 18, wherein:

the compressor discharge pressure comprises a static pressure; and the premixed combustor chamber pressure comprises a static pressure.

20. The system of claim 19, wherein the differential pressure probe is associated with a premixed combustor dynamics monitoring probe, the premixed combustor dynamics monitoring probe detecting a dynamic pressure in the premixed combustor.

21. The system of claim 16, wherein the differential pressure probe extends through a flow sleeve of the gas turbine into the premixed combustor of the gas turbine.

* * * * *